US006895858B2

(12) United States Patent
Kostiza et al.

(10) Patent No.: US 6,895,858 B2
(45) Date of Patent: May 24, 2005

(54) CYLINDER FOR A FOLDER UNIT

(75) Inventors: Simon Kostiza, Fussgönheim (DE); Viktor Cernovski, Worms (DE); Karl-Heinz Fischer, Heuchelheim (DE); Sebastian Alois Prüm, Kaiserslautern (DE); Rudolf Stäb, Frankenthal (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 24 days.

(21) Appl. No.: 10/475,848

(22) PCT Filed: Apr. 4, 2002

(86) PCT No.: PCT/DE02/01219

§ 371 (c)(1),
(2), (4) Date: Oct. 31, 2003

(87) PCT Pub. No.: WO02/090230

PCT Pub. Date: Nov. 14, 2002

(65) Prior Publication Data

US 2004/0152576 A1 Aug. 5, 2004

(30) Foreign Application Priority Data

May 3, 2001 (DE) ..... 101 21 559

(51) Int. Cl.[7] ..... B41F 13/02

(52) U.S. Cl. ..... 101/219; 101/409; 270/47; 493/424

(58) Field of Search ..... 101/219, 228, 101/408, 409, 410, 411; 270/13, 19, 20.1, 47–51, 60; 493/424–435, 476

(56) References Cited

U.S. PATENT DOCUMENTS

| | | | | |
|---|---|---|---|---|
| 3,521,878 A | | 7/1970 | Bolza-Schunemann | |
| 5,000,433 A | | 3/1991 | Prum et al. | |
| 5,065,993 A | | 11/1991 | Reponty | |
| 5,287,805 A | * | 2/1994 | Fischer et al. | 101/219 |
| 5,305,993 A | * | 4/1994 | Staeb | 270/37 |
| 5,772,571 A | * | 6/1998 | Marcle-Geller et al. | 493/426 |
| 6,514,188 B2 | * | 2/2003 | Kostiza | 493/424 |
| 6,550,385 B1 | * | 4/2003 | Colin et al. | 101/228 |
| 6,740,022 B2 | * | 5/2004 | Hachiya et al. | 493/424 |

FOREIGN PATENT DOCUMENTS

| | | |
|---|---|---|
| DE | 1 801 419 | 8/1973 |
| DE | 38 28 372 C2 | 12/1995 |
| DE | 196 16 629 A1 | 11/1997 |
| DE | 100 32 815 A1 | 1/2001 |
| EP | 0 436 102 A1 | 7/1991 |

* cited by examiner

*Primary Examiner*—Ren Yan
(74) *Attorney, Agent, or Firm*—Jones, Tullar & Cooper PC

(57) ABSTRACT

A collecting cylinder for a folder unit is provided with at least one disk cam that has peripheral switching depressions. These switching depressions can be covered by using an auxiliary curved trajectory which is created by a pivoting drive. Switching levers are selectively blocked or unblocked by motor-driven rotatable switching parts.

10 Claims, 3 Drawing Sheets

CYLINDER FOR A FOLDER UNIT

FIELD OF THE INVENTION

The present invention is directed to a cylinder for a folding apparatus. The cylinder uses rollers which run on at least one base cam disk. The cam disk is fixed in place and has troughs. The rollers are supported by levers and are used to switch cylinder fittings.

BACKGROUND OF THE INVENTION

A collecting cylinder is disclosed in EP 0 436 102 A1. This cylinder has a basic cam, fixed in place on the lateral frame, for use in the control of the cylinder fittings. In place of pivotable cover disks, the cylinder has electromagnetically actuable blocking bolts.

SUMMARY OF THE INVENTION

The object of the present invention is directed to providing a cylinder for a folding apparatus.

In accordance with the present invention, this object is attained by the provision of a cylinder that uses rollers which run on at least one base cam disk, which is fixed in place. The cam disk has troughs which the rollers, that are carried on levers, follow to switch cylinder fittings. An auxiliary cam path for the rollers, and which covers the troughs in the base cam disk, can be formed by the use of a switching element. This switching element selectively blocks or unblocks each roller lever. The switching element is arranged on the rotating cylinder. The roller lever can be blocked or unblocked by a rotary movement of the switching element. The switching element can be driven by a drive motor.

The advantages to be gained by the present invention rest, in particular, in that the switching element now employed in accordance with the present invention, allows short switching times, for example of approximately 1/300 seconds. Because of this, the exact and accurate switching of the cylinder fittings can take place, even at large circumferential speeds of the cylinder. The arrangement of a step motor in particular, together with very short switching paths generated by rotation, and the movement of small masses, is advantageous. Limitations of the switching times, of switching delays, which are difficult to calculate, as well as of inexact switching paths, which can occur, for example, because of hysteresis properties of magnetic switching devices, or the compressibility of pressure media, are prevented.

For example, it is possible, by the use of a collecting cylinder which is equipped with the switching element of the present invention, to accomplish single or up to triple collections, and to set, or change, these different collecting rhythms very rapidly and without elaborate technical outlay.

The cylinder for a folder unit, in accordance with the present invention, can be applied in connection with all fittings switchable on cylinders, such as grippers, point spurs, as well as with folding jaws.

BRIEF DESCRIPTION OF THE DRAWINGS

A preferred embodiment of the present invention is represented in the drawings and will be explained in greater detail in what follows. Shown are in.

DESCRIPTION OF THE PREFERRED EMBODIMENT

Figure 1:
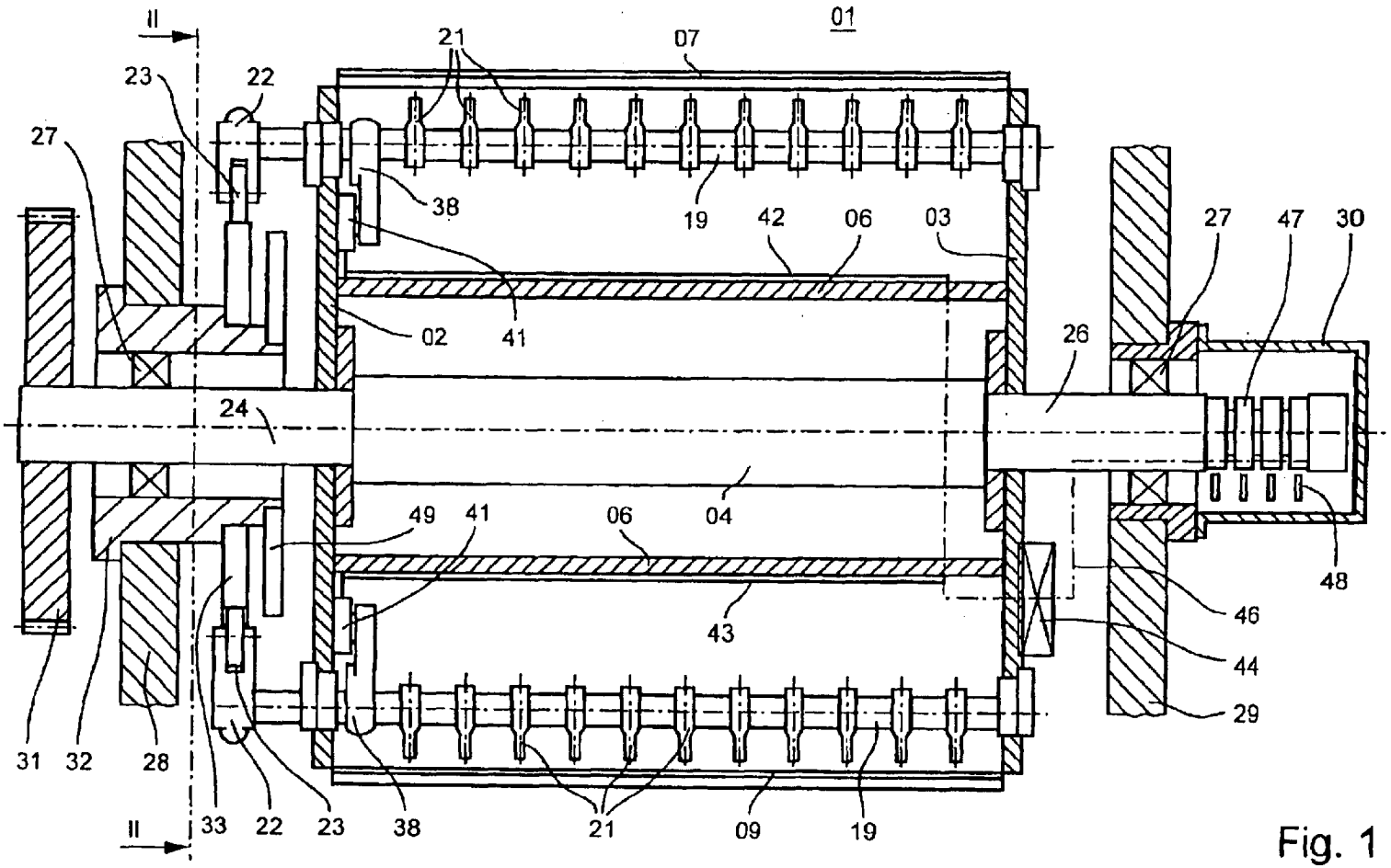
FIG. 1, a longitudinal cross-sectional through a cylinder in accordance with the present invention and taken along section line I—I in FIG. 2, in FIG. 2, a cross section through the cylinder of FIG. 1 and taken along section line II—II in FIG. 1, in FIG. 3, a schematic representation of a drive motor with a switching element and a switching lever, and in FIG. 4, a schematic representation of a variation of a drive motor with a switching element and a switching lever.

Referring initially to FIG. 1, there may be seen generally at 01 a cylinder for a folder unit in accordance with the present invention. Cylinder 01, which may be, for example, a five-part collecting cylinder 01 of a web-fed rotary printing press consists, for example, of two, or possibly more, spaced lateral disks 02, 03 arranged on a shaft 04 and separated from each other by cross pieces 06, if required. The cylinder 01 has a plurality of diverse cylinder fittings 07, 08, 09, 10, 11, 13, 14, 15, 16, 17 on its circumference. These can include, for example, five gripper systems 07, 08, 09, 10, 11, which are spaced apart from each other and between each of which is located a folding blade system 13, 14, 15, 16, 17, respectively. These cylinder fittings are only suggested or symbolically represented, and are arranged as depicted in FIG. 2.

Figure 2:
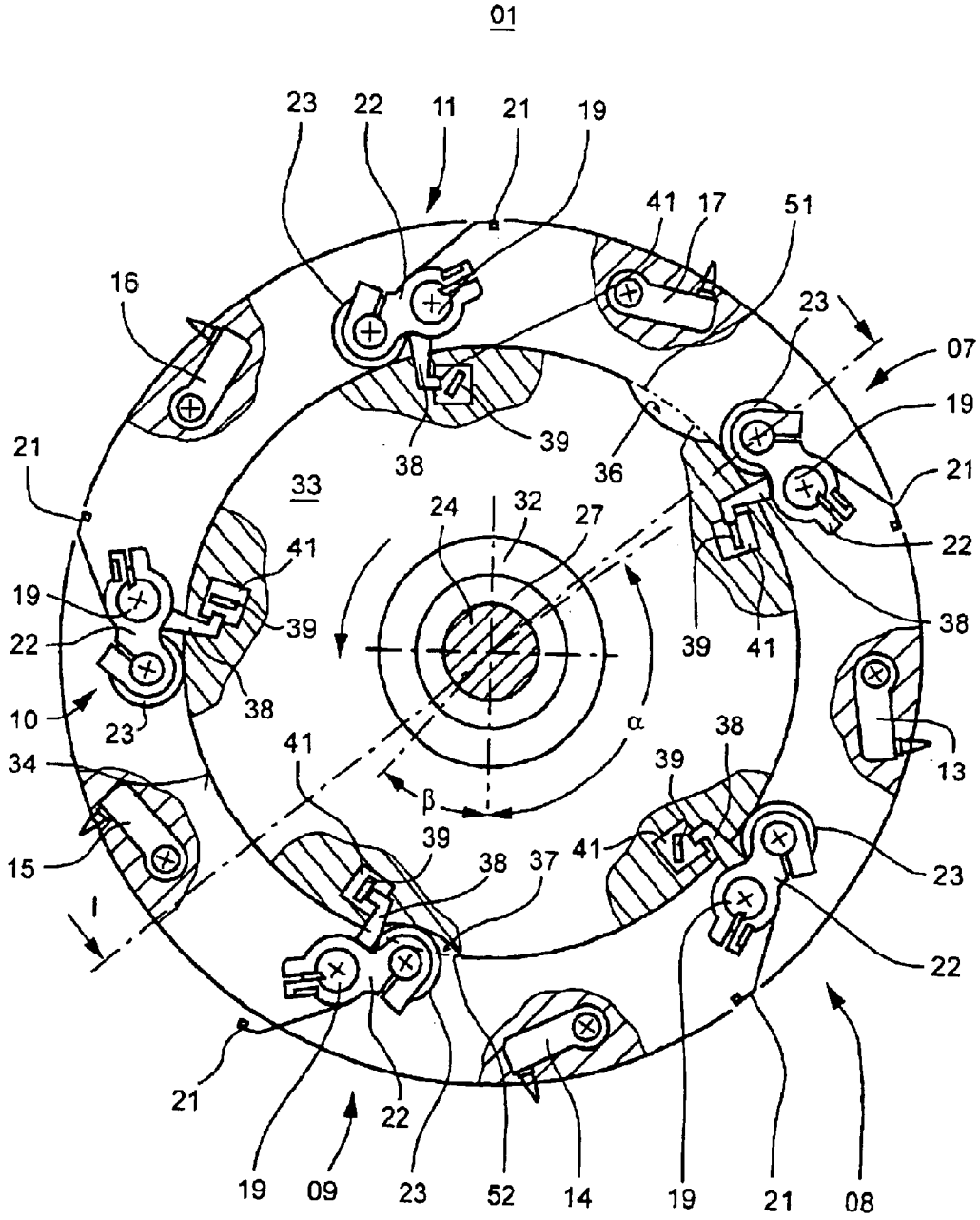

Each one of the gripper systems 07 to 11 has a support spindle 19, which is rotatably seated between the lateral disks 02, 03, with grippers 21 arranged, and fixed against relative rotation, on the support spindle 19 and spaced apart over the cylinder width, which grippers 21 can be moved against a gripper rest, which is not specifically represented in FIGS. 1 and 2.

On one end, the support spindle 19 has secured thereto a first end of a roller lever 22. The roller lever 22 receives a roller 23 on its second end, as seen in FIGS. 1 and 2.

The collecting cylinder 01 is seated in lateral frames 28, 29 of a folder unit, which is not specifically shown by use of shaft journals 24, 26 of shaft 04 and by the provision of various bearings 27, for example rolling bearings 27. The left shaft journal 24, as seen in FIG. 1, is connected with a gear wheel 31, for example a drive gear wheel 31.

A bushing 32, which is fixed in place in the lateral frame 28, and which receives the left rolling bearing 27, as well as the shaft journal 24 located within the left rolling bearing 27, is arranged on the driven side of the cylinder 01, i.e. in the left lateral frame 28. This bushing 22 supports at least one base cam disk 33, which is arranged parallel with respect to the lateral frame and between the lateral frame 28 and the lateral disk 02, and on whose cam disk periphery 34 the cam rollers 23 of the gripper systems 07 to 11 roll off.

On its periphery 34, the base cam disk 33 has various troughs 36, 37, for example a receiving trough 36, as well as a delivery trough 37. These troughs 36, 37 are seen most clearly in FIG. 2.

Figure 3:
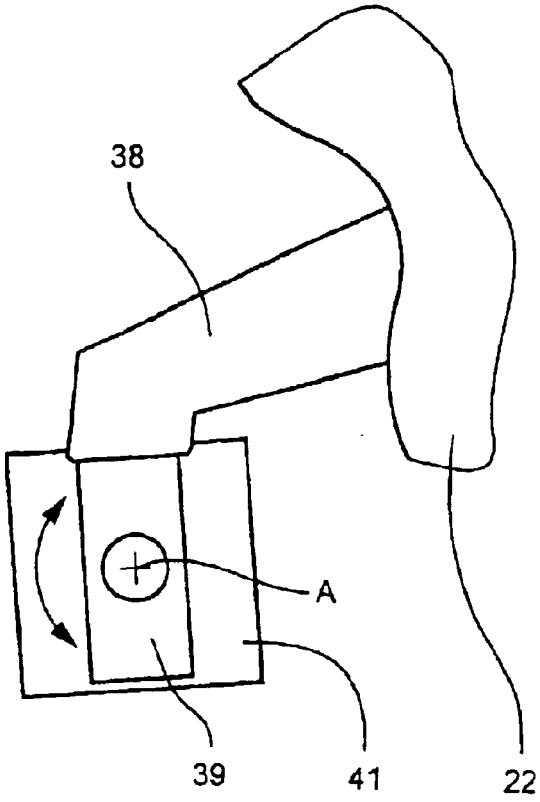
Figure 4:
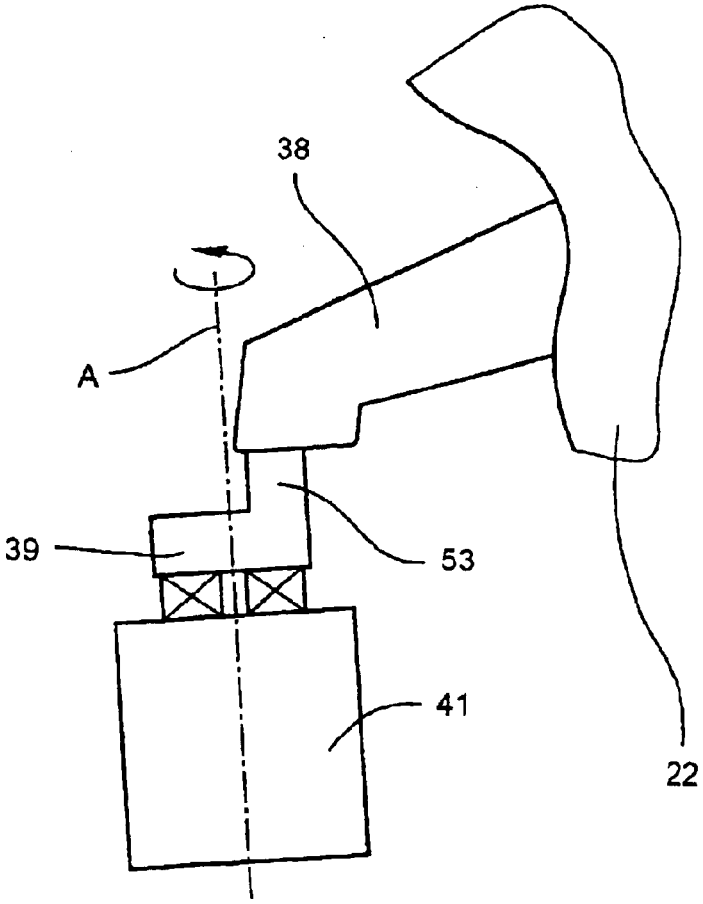

Adjacent the end of its respective support spindle 19, and inboard of the left lateral disk 02, each one of the cylinder fittings 07 to 11, i.e. each one of the gripper systems 07 to 11, has a switching lever 38, which is fixed on the support spindle and which extends approximately in the radial direction with respect to the shaft 04. The switching lever 38 is located in, and can extend in the interior of the cylinder in the vicinity of the lateral disk 02, as seen in FIG. 1. A free end of the switching lever 38 can enter into a connection with a cam-like or propeller-shaped switching element 39, which is rotatable around an axis of rotation A by operation of a drive motor 41 which is fixed in place on the left disk 02, all as seen in FIGS. 1, 2 and 3. In an advantageous embodiment, the switching element 39 is connected, fixed against relative rotation, with a motor shaft of the drive motor 41. The drive motor 41 is preferably configured as a step motor 41. The switching element 39 is configured as either a one-armed lever or as a double-armed lever 39, for example, wherein a free end of the lever 39 can be used as a stop for the free end of the switching lever 38 and can block it as depicted in FIGS. 3 and 4.

Each one of the drive motors 41 assigned to the individual gripper systems 07 to 11 is connected by lines 42, 43 with an electrical control unit 44 which is located, for example, on the exterior of the right lateral disk 03, as seen in FIG. 1. This control unit 44 is connected by a line 46 extending over, or through the right shaft journal 26, with a collector ring body 47, which is located on the shaft journal 47 and which is enclosed in a housing 30. The output lines 48 of the collector rings lead to a central control device, which is not specifically represented.

It is, of course, also possible to arrange a rotatable transmitter unit, that is also not represented, in place of the collector ring body 47, and to transmit the control signals in a contactless manner via a stator, also not represented, to the central control device, and to receive fresh control signals from the latter.

It is furthermore possible to arrange a second base cam disk 49, for use with the folding blade systems 13 to 17 on the bushing 32, and thus fixed in place on the lateral frame. Parts of these folding blade systems 13 to 17 are rollers and roller levers, which are similar to the ones discussed in connection with the gripper systems 07 to 11, and which are not represented. As in connection with the gripper systems 07 to 11, switching levers, switching elements, as well as step motors, not specifically represented, are also provided for the folding blade systems 13 to 17. The embodiment of the lateral disks 02, 03 as multi-piece lateral disks 02, 03 is advantageous, wherein the folding blade systems 13 to 17 and the gripper systems 07 to 11 are each supported by separate pairs of lateral disks and thus can be rotated in respect to each other.

In this multiple disk pair embodiment, which is not specifically shown, the shaft journal 24 is advantageously embodied as a hollow shaft and is connected, for example, with the lateral disk 02 for the support spindle 19 of the gripper systems 07 to 11. For example, a second shaft journal, which is not represented, of the lateral disk, also not represented, of the folding blade systems 13 to 17 is arranged inside the shaft journal 24 which is embodied as a hollow shaft.

The systems of the cylinder 01 for a folder unit in accordance with the present invention operate as follows:

In response to the control signals received via the control unit 44, the drive motors 41 are each actuated by the rotation of their motor shafts in such a way that the free end of the propeller-shaped switching element 39 is brought into a tangential position with respect to the cylinder cross section, as depicted with the gripper system 07, or into a radial position with respect to the cylinder cross section, as depicted with the gripper system 09. The gripper system 08 shows the switching element 39 within a switching angle $\alpha$ of rotation of the cylinder 01, while the gripper system 09 shows the switching element 39 in a resting phase within an angle $\beta$ of rotation of the cylinder 01. At high numbers of revolutions of the collecting cylinder 01, along with high circumferential speeds, the switching element 39 must arrive in its new position within the switching angle $\alpha$ of rotation of the cylinder 01 very quickly, in particular within a time of less than 1/300 second, and dependably.

In the tangential position of the switching element 39, the switching lever 38 of the support spindle 19 is blocked. In this configuration the rollers 23 cannot dip into the trough 36. An auxiliary cam track 51 is thereby created, which auxiliary cam track 51 prevents the opening of the gripper systems 07 to 11 when the rollers 23 pass through.

In the radial position of the switching element 39, as seen in the gripper system 09, the roller 23 passes through the delivery trough 37 and the grippers 21 will now open. In the tangential position of this switching element 39, an auxiliary cam track 52 would be created for the rollers 23, and the delivery of imprinted products would be prevented. The axis of rotation A of the switching element 39 which, in the embodiment depicted in FIG. 3, is congruent with the motor shaft of the drive motor 41, extends axis-parallel with respect to the support spindle 19.

The same operating sequence is also applicable in connection with the folding blade systems 13 to 17, which are not represented in detail.

In accordance with a second preferred embodiment, as depicted in FIG. 4, it is also possible for a free end of the rotatable lever 39 of the switching element to have a cam 53, which cam extends almost at right angles to the switching element 39 and axis-parallel with the axis of rotation A of the switching element 39, or the motor shaft, and which cam 53, in a blocking position, is rotated underneath the free end of the switching lever 38 and blocks it, so that the support spindle 19 is also not rotatable.

In this second embodiment, the motor shaft of the drive motor 41 extends in a secant-like direction with respect to the cylinder cross section in accordance with FIG. 2.

It is moreover also possible to employ lifting magnets, which are not specifically represented, for switching the systems, for example for opening and closing the gripper systems 07 to 11, in place of the previously mentioned drive motors 41.

The switching lever 38 can also be brought into two different positions by the different placement of the lifting drive.

The generation of the auxiliary cam tracks 51, 52 can be employed in the same or in a similar manner use with cylinders intended for cutting or folding.

While preferred embodiments of a cylinder for a folder unit, in accordance with the present invention have been set forth fully and completely hereinabove, it will be apparent to one of skill in the art that various changes in, for example the overall size of the cylinder, the number of cylinder fittings on the cylinder, and the like could be made without departing from the true spirit and scope of the present invention which is accordingly to be limited only by the following claims.

What is claimed is:

1. A cylinder for a folding apparatus comprising:

a rotatable cylinder body;

at least one switchable cylinder fitting on said cylinder body;

at least one roller lever usable to operate said at least one switchable cylinder fitting;

a roller carried by said roller lever;

at least one fixed base cam disk, said at least one fixed base cam disk having a cam path including at least one trough, said cam path being followed by said roller;

a switching element arranged on the rotatable cylinder body; and a drive motor for rotating said switching element about an axis of rotation, said rotary motion of said switching element selectively blocking and unblocking said lever, said switching element, in said lever blocking position, defining an auxiliary cam path.

2. The cylinder of claim 1 wherein said drive motor has a motor shaft and wherein said axis of rotation of said switching element is parallel with said motor shaft.

3. The cylinder of claim 1 wherein said drive motor is a step motor.

4. The cylinder of claim 1 wherein said at least one switchable cylinder fitting includes a support shaft, wherein said at least one lever is fixed in place on said support shaft and wherein said switching element acts as a stop for said lever when said switching element is in said lever blocking position.

5. The cylinder of claim 1 further including a control unit on said rotatable cylinder body and connected by lines to said drive motor.

6. The cylinder of claim 5 wherein said control unit is connected with a stator, said stator, said stator receiving control signals from a central control device.

7. The cylinder of claim 1 wherein said switching element is a circularly pivotably lever having at least one lever arm, said lever arm blocking said at least one roller lever, and wherein said at least one switchable cylinder fitting includes a support shaft, said pivotable lever having an axis of rotation, said pivotable lever axis of rotation extending parallel with said support shaft.

8. The cylinder of claim 7 wherein said drive motor includes a motor shaft and wherein said switching element is on said motor shaft and further wherein an axis of rotation of said switching element is the same as an axis of rotation of said motor shaft.

9. The cylinder of claim 1 wherein said switching element is a circularly pivotable lever having a cam, wherein said drive motor has a motor shaft with said cam extending parallel with said motor shaft and toward said roller lever, further wherein said at least one switchable cylinder fitting includes a support shaft with a switching lever secured to said support shaft and having a free end, said switching element cam, in said blocking position, extending under said free end of said switching lever, said switching element having an axis of rotation extending in a secant-like direction in respect to a cross section of said cylinder.

10. The cylinder of claim 9 wherein said switching element is on said motor shaft and further wherein an axis of rotation of said switching element is the same as an axis of rotation of said motor shaft.

* * * * *